US005788144A

United States Patent [19]

Sorge et al.

[11] Patent Number: 5,788,144

[45] Date of Patent: Aug. 4, 1998

[54] COMBINED PICTURE FRAME AND MAILER

[75] Inventors: William Sorge, deceased, late of New York, by Dorothy Sorge, executor; Philip Cesario, New York; Daniel Fier, Rock Hill; Frank Conti, New York, all of N.Y.

[73] Assignee: Say It With A Picture, Inc., New York, N.Y.

[21] Appl. No.: 771,375

[22] Filed: Dec. 16, 1996

Related U.S. Application Data

[63] Continuation of Ser. No. 516,972, Aug. 18, 1995, abandoned.

[51] Int. Cl.[6] ..... B65D 27/04

[52] U.S. Cl. ..... 229/92.8; 229/71

[58] Field of Search ..... 229/92.8, 71

[56] References Cited

U.S. PATENT DOCUMENTS 4,366,636 1/1983 Hearsh ..... 229/72 X

FOREIGN PATENT DOCUMENTS 72996 8/1951 Denmark ..... 229/71

*Primary Examiner*—Jes F. Pascua

*Attorney, Agent, or Firm*—Bauer & Schaffer

[57] ABSTRACT

A combined picture frame and mailer is formed of a single piece of reinforced paper folded along a horizontal axis into two substantially equal halves forming front and back panels. The front panel has a central cutout providing a window behind which the picture is placed and which is covered by a transparent sheet of cellophane. The back panel is provided with flaps about its remaining peripheral edges which fold over the corresponding edges of the front panel, and which are sealed to form a closed thin envelope. The back panel is also provided with fold out legs permitting the frame to stand alone on a flat surface such as a table as well as space in which the user may write a message as on a postcard.

2 Claims, 2 Drawing Sheets

COMBINED PICTURE FRAME AND MAILER

This is a continuation of Ser. No. 08/516,972, filed Aug. 18, 1995, now abandoned.

BACKGROUND OF THE INVENTION

The present invention relates to a combined picture frame and mailer, and, in particular, to a frame for holding photographs and the like for both mailing and display.

A number of picture frame mailers have been suggested as, for example, in U.S. Pat. Nos. 1,347,269, 2,219,492, 4,237,633, 4,640,030, 4,662,093, 4,681,253, 4,780,975, 5,337,949, and 5,365,684. Nevertheless, few of these have found wide commercial success largely because they are somewhat cumbersome in construction, difficult to assemble and too large or heavy for inexpensive mailing. Another problem lies in the failure to provide adequately sturdy support means whereby once received by the addressee, they may be erected in a stand-alone manner.

It is, therefore, the object of the present invention to provide an improved combined picture frame and mailer which is simple in construction, easily erected, light but sturdy and quite inexpensive.

It is a significant object of the present invention to provide an improved combined picture frame and mailer having the same attributes in construction and use as that of a postal card.

These objects, as well as others will be seen from the following disclosure.

SUMMARY OF THE INVENTION

According to the present invention a combined picture frame and mailer is provided comprising a single piece of reinforced paper folded along a horizontal axis into two substantially equal halves forming front and back panels. The front panel has a central cutout providing a window behind which the picture may be placed and which is covered by a transparent sheet of cellophane or the like. The back panel is provided with flaps about its remaining peripheral edges which fold over the corresponding edges of the front panel, and which are sealed to form a closed thin envelope. The back panel is also provided with fold out legs permitting the frame to stand alone on a flat surface such as a table or the like as well as space in which the user may write a message or the like.

Full details of the present invention are set forth in the following description and illustrated in the accompanying drawings.

DETAILED DESCRIPTION OF THE INVENTION

Figure 1:
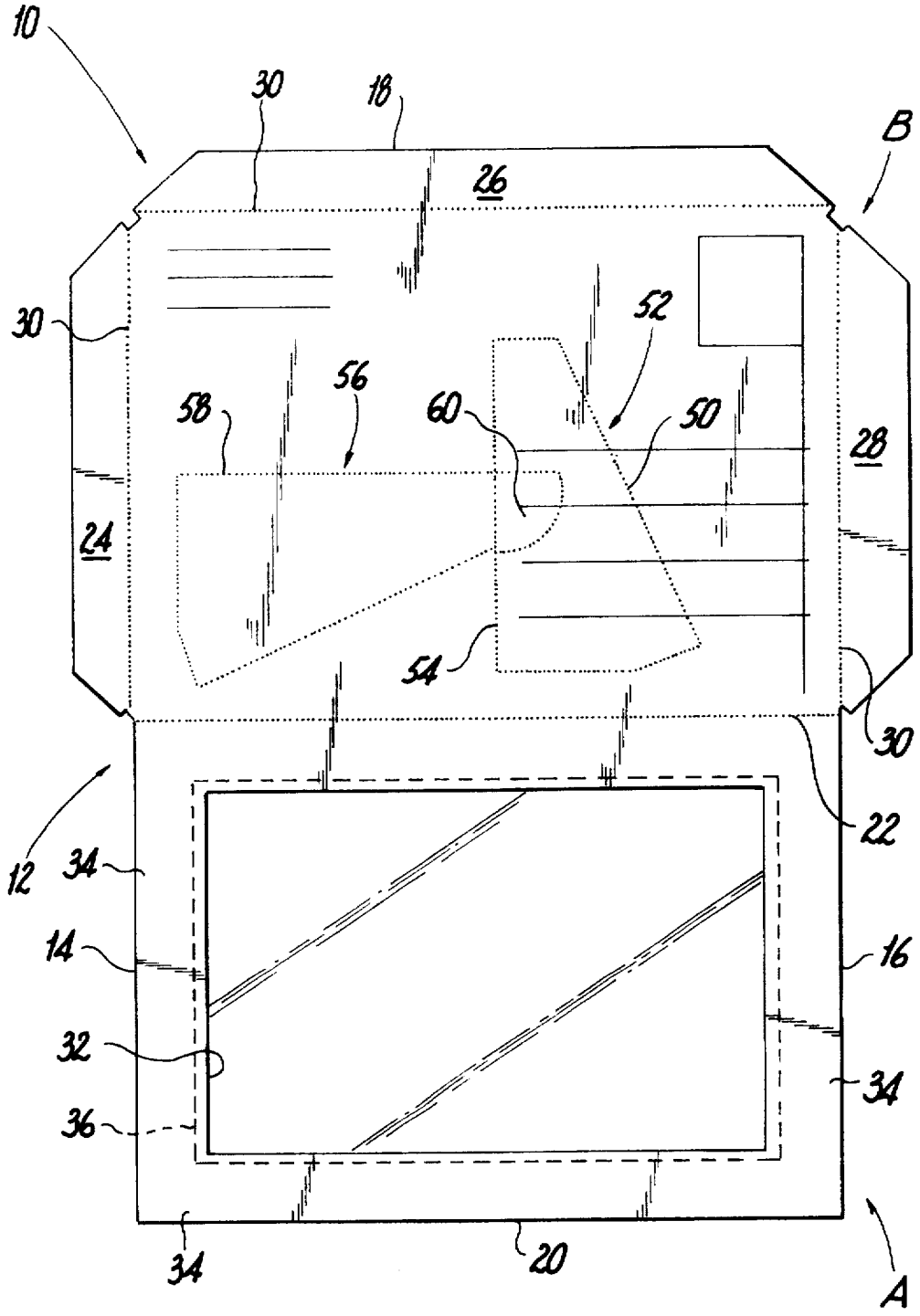
FIG. 1 is a plan view of the blank from which the combined frame and mailer assembly is constructed.

As seen in the drawings, the combined picture frame and mailer of the present invention, hereinafter referred to as the assembly, is generally depicted by the numeral 10. The assembly 10, as seen in detail in FIG. 1, is formed of a unitary rectangular blank 12 of paper material, such as coated cardboard formed with elongated side edges 14 and 16 and transverse top and bottom edges 18 and 20, respectively. Substantially midway between the top and bottom edges 18 and 20 the blank 12 is provided with a fold line 22 dividing it into two sections A and B, which, when the blank is folded, form the front and back panels respectively of the assembly 10 and a storage space therebetween.

Figure 2:
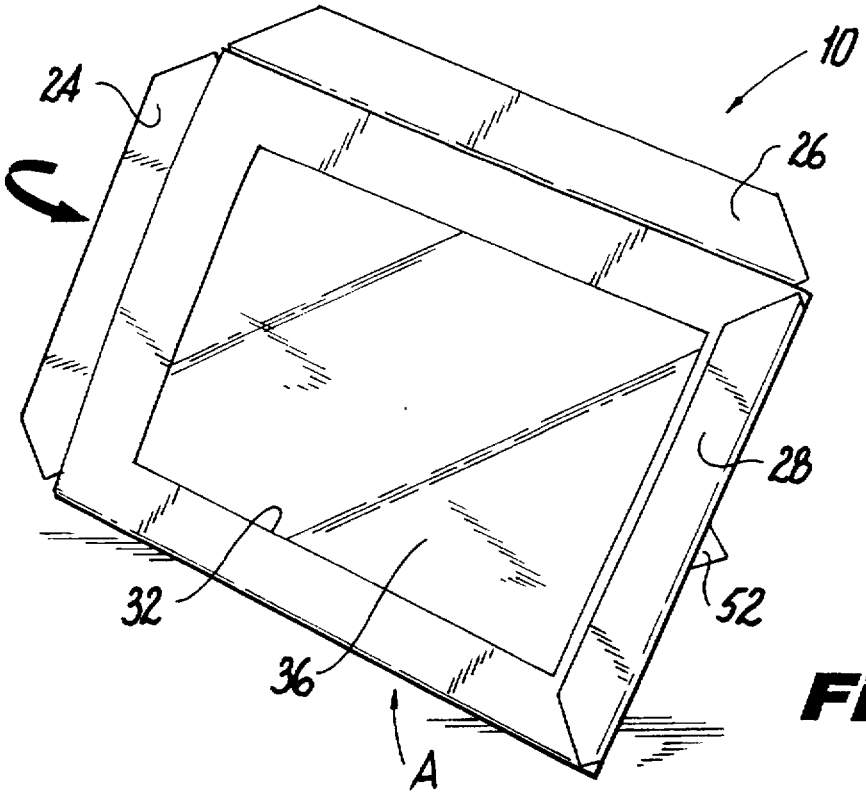
FIG. 2 is a front perspective view of the assembly when erected.

The section of the blank 12 forming the back panel B is provided with outwardly extending flaps 24, 26 and 28 at each of the side edges 14 and 16 as well as the top edge 18, respectively. The flaps 24, 26 and 28 are integrally formed with the panel B along the stated edges and are defined by fold lines 30. The flaps 24, 26 and 28 are narrow in width but substantially the length of the corresponding edges 14, 16 and 20 of the front panel A so that they may be folded over and sealed to the front panel A along its marginal edges, as seen in FIG. 2.

The front panel A is provided with a central cutout 32, here shown as rectangular, although the shape may be varied as desired. The cutout 32, in any shape, should be dimensioned so that the marginal edges 34 of the panel A are sufficiently large as to permit the flaps 24, 26, and 28 to be contained therein. The cutout 32 provides a window into or behind which the user places a picture such as a photograph or the like. The window is covered on its interior surface with a transparent sheet 36 of material such as cellophane, celluloid, clear plastic or the like. Preferably, the sheet 34 is adhered about its entire periphery, as by gluing, heat sealing or the like so as to insure integrity of the front panel A. Since the transparent sheet 36 is located on the inner surface, its edges will normally be hidden from view when the assembly is erected, and the exterior of the assembly will seem integral as well as unitary as seen in FIG. 2.

Preferably, as seen from the Figures, the rear surface 40 of the top panel B (i.e. the windowless panel) is imprinted with an address portion 42, a correspondence portion 44, a return address portion 46 and stamp portion 48, which simulates a postcard. Thus, the photograph a personal message may be applied to the mailer.

Figure 3:
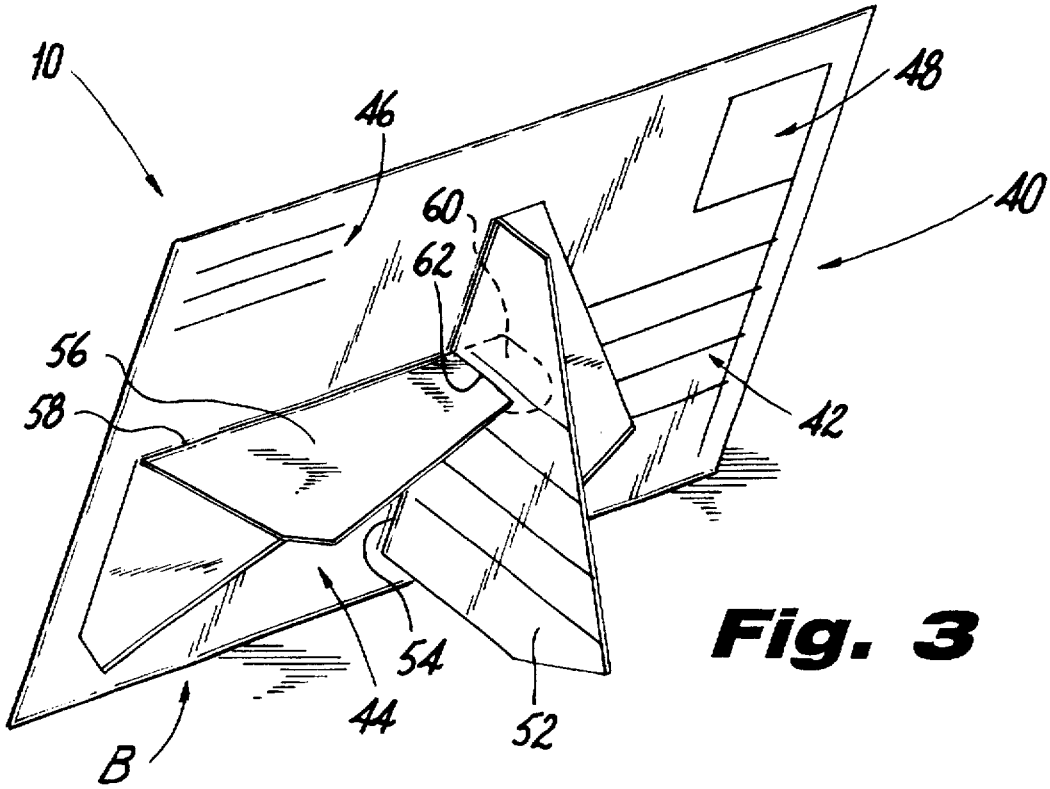
FIG. 3 is a rear perspective view of the erected assembly.

Lastly, the back panel is scored along lines 50 shaped to provide a vertically directed brace 52 which pulled away from panel and folded along line 54 enables the assembly to stand and rest, slightly tilted backward, on a flat surface. A horizontal brace 56 is similarly provided to fold over a line 58. The second or horizontal brace is formed with a head 60, which, having been cut from within the area of the vertical brace, leaves a hole 62 in the vertical brace 52. The head 60 and hole 62 cooperate so that the vertical and horizontal brace interlock, as seen in FIG. 3.

In assembling this picture frame and mailer, from the blank 12 seen in FIG. 1 the front and back panel A & B, with the transparent sheet 36 in place, is folded along line 22 so as to lie against each other. The side flaps 24 and 28 are then folded over and secured to the corresponding marginal edges 34 of the front panel. The top flap 26 is not secured pending insertion of the photograph or similar indicia device into the pocket, thus leaving the assembly open for later insertion of the picture or photo. In this manner, the assembly provides a relatively thin, lightweight envelope which is easy to display at a point of purchase. After the picture or photo is inserted, the assembly is closed by folding the top flap 26, addressed and stamped so as to be used as a postal card.

Upon receipt, the photograph need not be disturbed, and the recipient can read the correspondence as if it were a conventional postal card. If the recipient wishes to retain the photograph and display it, all the recipient needs to do is pull out braces 52 and 56 and interlock them.

Various modifications and changes have been disclosed herein, and others will be apparent to those skilled in this art. Therefore, it is to be understood that the present disclosure is by way of illustrating and not limiting of the present invention.

What is claimed is:

1. A combined picture frame and mailer assembly comprising a picture receiving pocket formed of a unitary polygonal blank folded along a longitudinal midline into a front panel and a substantially similar back panel to define the receiving pocket, each of said back and front panels having opposed side edges and a top edge opposite to the midline, each side edge of one of said panels being provided with flaps along each of said edges folded over the side edges of the other one of said panels and secured to the corresponding marginal edges of the other panel, the top edge of said one panel having a free flap defining with the top edge of said other panel an opening into the receiving pocket for the removable insertion of a picture, said free flap adapted to fold and overlie the top edge of the other panel and having means to selectively fixedly close said pocket after insertion of said picture, the other panel having a central window to display said picture, the periphery of said window being spaced from the marginal edges to which said side edges are attached and a transparent sheet adhered to the inner surface of said front panel and covering said window, said back panel being scored to provide a shaped portion partially removable from said back panel to form a support for said assembly adapted to maintain said assembly substantially vertical to said support, said back panel being imprinted with indicia for mailing and for providing a written personal message.

2. The assembly according to claim 1, including brace means for locking said support in fixed position, said means comprising a shaped member partially removable from said back panel to engage with and secure said support.

* * * * *